US007152810B2

(12) United States Patent
Gau et al.

(10) Patent No.: US 7,152,810 B2
(45) Date of Patent: Dec. 26, 2006

(54) MICRO-DROPLET GENERATOR WITH AUTOSTABILIZATION FUNCTION OF NEGATIVE PRESSURE

(75) Inventors: Tien-Ho Gau, Hsinchu (TW); Yu-Yin Peng, Hsinchu (TW); Chin-Pin Chien, Taipei Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 75 days.

(21) Appl. No.: 10/785,591

(22) Filed: Feb. 23, 2004

(65) Prior Publication Data

US 2005/0109859 A1 May 26, 2005

(30) Foreign Application Priority Data

Nov. 24, 2003 (TW) ..... 92132957 A

(51) Int. Cl.

| | |
|---|---|
| ***B05B 1/08*** | (2006.01) |
| ***B05B 3/04*** | (2006.01) |
| ***B05B 1/30*** | (2006.01) |
| ***B05B 1/04*** | (2006.01) |

(52) U.S. Cl. ..... 239/102.2; 239/102.1; 239/533.14; 239/596; 239/594; 239/601

(58) Field of Classification Search ..... 239/102.2, 239/102.1, 533.14, 596, 594, 601
See application file for complete search history.

(56) References Cited

U.S. PATENT DOCUMENTS

| | | | | |
|---|---|---|---|---|
| 5,072,240 | A * | 12/1991 | Miyazawa et al. | 347/22 |
| 5,666,141 | A * | 9/1997 | Matoba et al. | 347/54 |
| 6,116,517 | A * | 9/2000 | Heinzl et al. | 239/101 |
| 6,764,023 | B1 * | 7/2004 | Peng et al. | 239/101 |
| 6,848,635 | B1 * | 2/2005 | Xu | 239/533.12 |

* cited by examiner

*Primary Examiner*—Davis Hwu
(74) *Attorney, Agent, or Firm*—Pro-Techtor Int'l Services

(57) ABSTRACT

A micro-droplet generator, comprising a chamber, enclosed by a casing, a spraying plate, having a plurality of spraying holes, a piezoelectric plate, a signal connector, and a storage tank. The piezoelectric plate is mounted inside the chamber, having a fixed end fastened on the casing and a free end performing a bending movement. The input port issues signals that cause the bending movement of the piezoelectric plate. The chamber and the storage tank contain liquid, with a constant difference of liquid levels in the chamber and the storage tank being maintained, so that negative pressure in the chamber is automatically regulated.

9 Claims, 4 Drawing Sheets

MICRO-DROPLET GENERATOR WITH AUTOSTABILIZATION FUNCTION OF NEGATIVE PRESSURE

BACKGROUND OF THE INVENTION

1. Field of the Invention

The present invention relates to a micro-droplet generator, particularly to a micro-droplet generator for spraying gasoline, machine oil, essence or other fluids from a chamber, wherein negative pressure is maintained in the chamber to avoid leaking due to gravitation, and a spraying plate with a microstructure is used, having gradually narrowing holes and gradually widening holes for completely removing drops from the spray plate if spraying force is not sufficient.

2. Description of Related Art

A micro-droplet generator needs to maintain a negative pressure to avoid leaking due to gravitation. To prevent a reduction in the rate of sprayed fluid because of too large negative pressure, automatic regulation of the negative pressure is required. Furthermore, if spraying force is insufficient, remaining liquid will accumulate on spraying plate, blocking normal exchange of liquid and air through holes, so that continuous spraying is hampered.

U.S. Pat. No. 6,116,517 "Droplet mist generator", as shown in FIGS. 4–6, discloses a droplet generator having a chamber 1 which is via two tubes connected with a storage tank (not shown), a piezoelectric plate 2, and a plurality of spraying holes 3. The characteristics of the droplet generator are as follows. (1) The piezoelectric plate 2 is horizontally placed inside the chamber 1, performing a vibrating movement driving droplets out of the spraying holes 3 on one side of the piezoelectric plate 2. (2) The spraying holes 3 are oriented parallel to the vibrating movement of the piezoelectric plate 2. (3) The spraying holes 3 are oriented perpendicular to the vibrating movement of the piezoelectric plate 2 (not shown) . The vertical vibrating movement of the piezoelectric plate 2 drives droplets simultaneously and on a common side out of the spraying holes 3.

For simultaneous refilling of fluid and removing of air bubbles, restrictions in the directions of spraying and a refilling system are required. Furthermore, control of negative pressure is not mentioned in the cited patent, so that the following shortcomings result: (1) Due to gravitation, liquid sticks to the spraying surface, blocking spraying of droplets, thus hampering continuous spraying of droplets. (2) Refilling of fluid and removing of air bubbles depends on the effect of gravitation and hydrostatic pressure, restricting directions of spraying.

SUMMARY OF THE INVENTION

It is an object of the present invention to provide a micro-droplet generator with automatic control of negative pressure, so that leaking of liquid due to gravitation is prevented, more effective spraying of droplets is achieved and no blocking of spraying due to lack of liquid accumulation on spraying plate.

The present invention has a piezoelectric plate which is driven by an input signal, bending and pressing liquid contained in a chamber therein, which thereupon is squeezed out through spraying holes. When the piezoelectric plate bends in the opposite direction, negative pressure builds up in the chamber, and air from outside is sucked into the chamber. By using gradually narrowing holes and gradually widening holes as spraying holes, liquid remaining on a spraying surface on the spraying holes is minimized, and an automatic regulation of negative pressure is achieved. Thus leaking of liquid is prevented and effective spraying is achieved.

Another object of the present invention is to provide a micro-droplet generator having a chamber that is continuously refilled from a storage tank, so that negative pressure remains constant.

In the present invention, the pressure by the piezoelectric plate overcomes hydrostatic pressure that occurs due to a difference of the levels of liquid in the chamber of the piezoelectric plate and the storage tank.

The present invention can be more fully understood by reference to the following description and accompanying drawings.

DETAILED DESCRIPTION OF THE PREFERRED EMBODIMENTS

As shown in FIG. 1, the micro-droplet generator of the present invention mainly comprises: a chamber 10, containing a liquid; a spraying plate 20, having a plurality of spraying holes 21, through which droplets L of the liquid are sprayed out; a piezoelectric plate 30, performing a bending movement; a signal connector 40; and a storage tank 50.

The chamber 10 is enclosed by a casing 11. The casing 11 on one side has an opening 12, through which a conduit 13 passes. The plurality of spraying holes 21 of the spraying plate 20 are arranged on a lateral side or a lower side of the casing 11. The piezoelectric plate 30 is composed of several layers of different piezoelectric materials and placed inside the chamber 10, having a fixed end fastened to the casing 11 and a free end placed at a distance to the spraying plate 20, allowing the piezoelectric plate 30 freely to perform the bending movement parallel to the axes of the spraying holes 21. The signal connector 40 is placed on one side of the piezoelectric plate 30 and driven by a controller, causing the piezoelectric plate 30 to perform the bending movement. The storage tank is filled with the liquid to be sprayed. The chamber 10 and the storage tank 50 have liquid levels with a constant difference H. The spraying hole 21 are made of microstructures. In another embodiment, the spraying holes 21 are gradually narrowing holes 22 and gradually widening holes 23.

The signal connector 40 issues a signal to the piezoelectric plate 30, causing the piezoelectric plate 30 to perform the bending movement, exerting pressure on the liquid in the chamber 10. Therefore, the liquid is squeezed out through the spraying holes 21 in the casing 11. When the piezoelectric plate 30 performs a reverse bending movement, air is through the spraying holes 21 sucked into the chamber 10. For the difference H of liquid levels in the chamber 10 and the storage tank 50 to be constant, a resulting lower hydrostatic pressure is overcome by liquid flowing from the storage tank 50 into the chamber 10, refilling the chamber 10. In a still state, due to negative pressure in the chamber 10 as well as surface tension of the liquid, no liquid leaks out of the chamber 10.

Another characteristic of the present invention lies in that, even without refilling of liquid into the chamber 10 from the storage tank 50 (sealing the chamber 10 except for the spraying holes 21), an exchange of liquid and air takes place at the spraying holes 21, improving on U.S. Pat. No. 6,116,517.

Referring to FIGS. 2 and 3, the gradually narrowing holes 22 and the gradually widening holes 23 ensure that liquid remaining on the spraying plate 20 is removed. The gradually narrowing holes 22 result in increased spraying force, and the gradually widening holes 23 allow external air bubbles 25 easily to enter the chamber 10, balancing pressure there and sucking in remaining liquid on the outer surface of the spraying plate 20, so that blocking of spraying of droplets by accumulating liquid on the spraying plate 20 is avoided. Since accumulating liquid on the spraying plate 20 blocks natural exchange of liquid with air, continuous spraying is hampered. As shown in FIG. 2, when the piezoelectric plate 30 bends towards the spraying plate 20, liquid placed in between is exposed to pressure and subsequently pressed out through the spraying holes 21 in the casing 11. When, as shown in FIG. 2, the piezoelectric plate 30 bends away from the spraying plate 20, air is sucked into the chamber 10 through the spraying holes 21.

As above explanation shows, in the droplet generator of the present invention, constant negative pressure is maintained in the chamber, leaking of liquid through the spraying holes in a still state is avoided, and by employing spraying holes in the spraying plate that are made of a microstructure, effective spraying of micro-droplets is achieved. Gradually narrowing and widening holes in the spraying plate increase spraying force and ensure that no liquid remains on the outer surface of the spraying plate.

While the invention has been described with reference to preferred embodiments thereof, it is to be understood that modifications or variations may be easily made without departing from the spirit of this invention which is defined by the appended claims.

Figure 1:
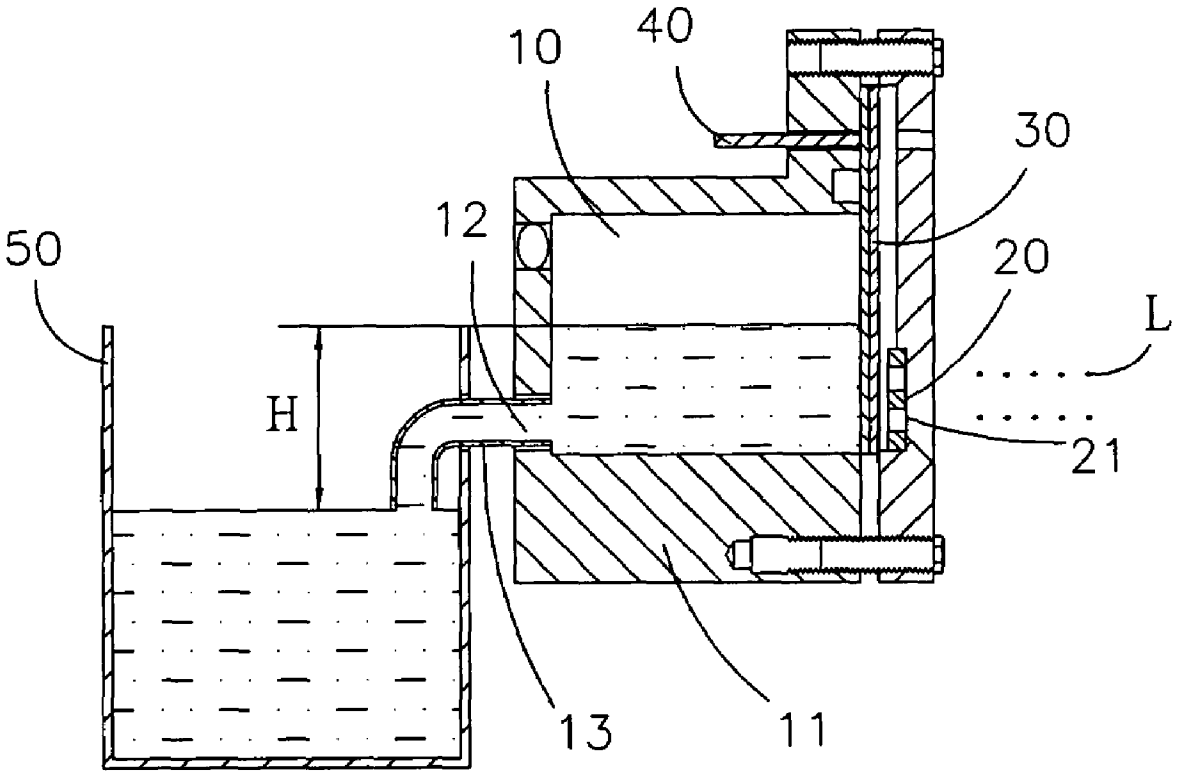
FIG. 1 is a sectional side view of the micro-droplet generator of the present invention.
Figure 3:
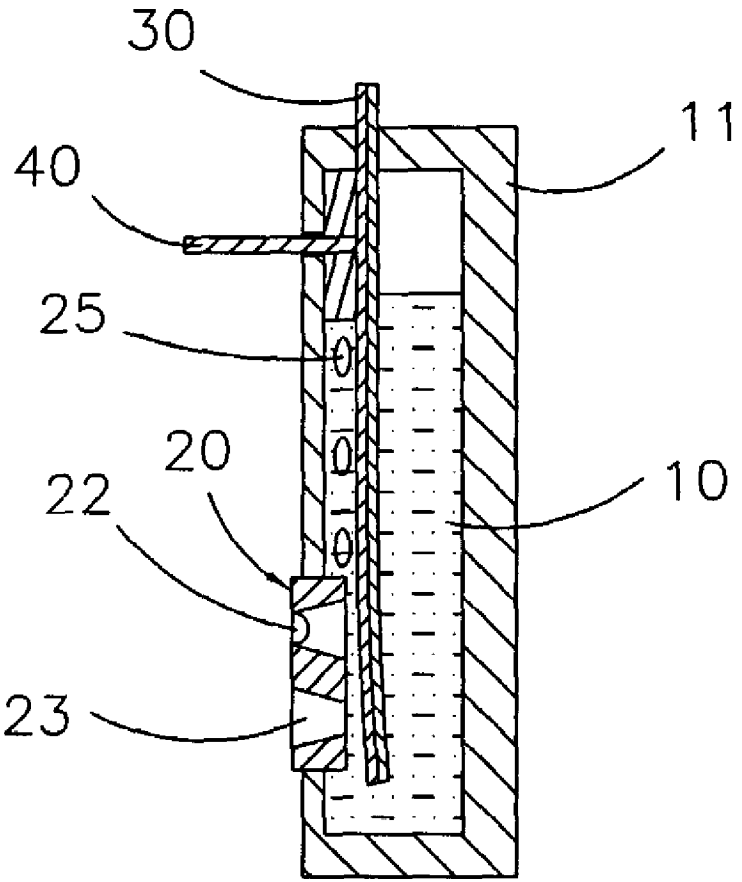
FIG. 3 is a sectional side view of the spraying plate and the chamber of the present invention during sucking
Figure 2:
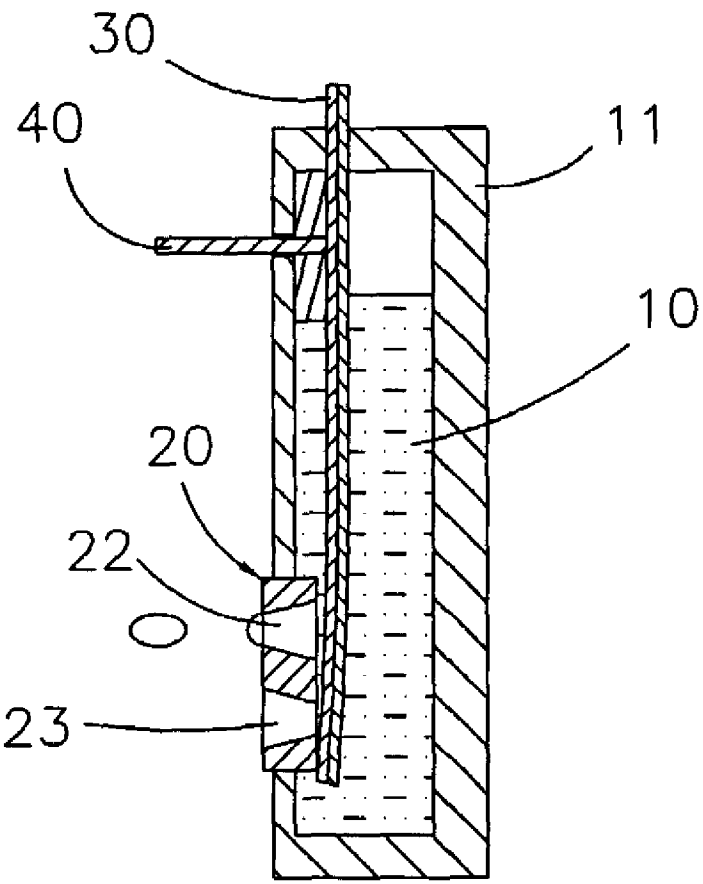
FIG. 2 is a sectional side view of the spraying plate and the chamber of the present invention during spraying of droplets.
Figure 4:
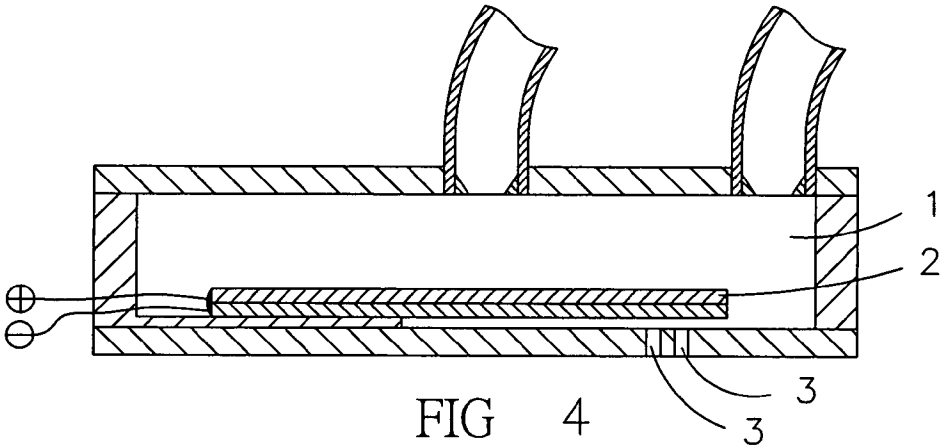
FIG 4 (PRIOR ART)
FIG. 4 is a sectional side view of the droplet generator disclosed in U.S. Pat. No. 6,116,517.
Figure 5:
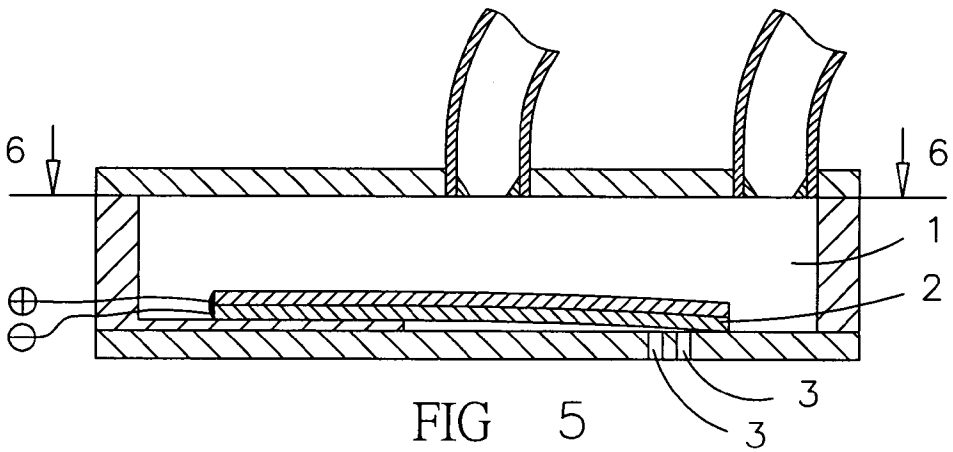
FIG 5 (PRIOR ART)
FIG. 5 is a sectional side view of the droplet generator of FIG. 4, with the piezoelectric plate bending.
Figure 6:
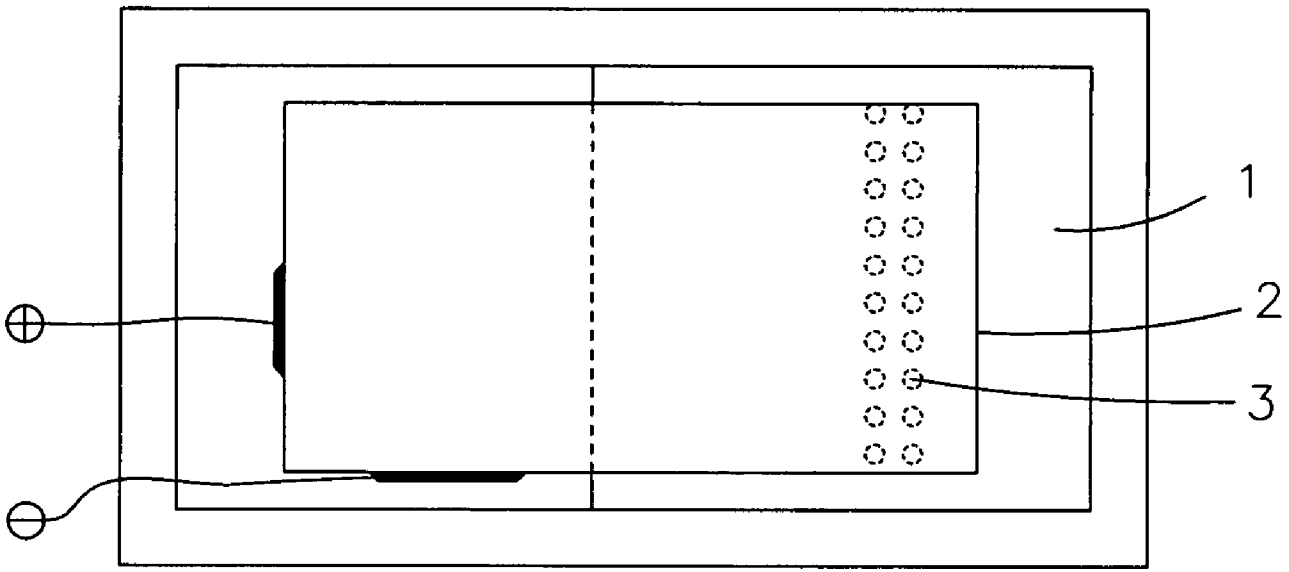
FIG 6 (PRIOR ART)
FIG. 6 is a sectional view along line 6—6 of FIG. 5.

The invention claimed is:

1. A micro-droplet generator, comprising:

a chamber having a negative internal pressure, enclosed by a casing;

a spraying plate having an inner major surface and an outer major surface opposite, forming a portion of one side of said casing, said spraying plate, having a plurality of spraying holes, said spraying holes being through-holes connecting an opening on said inner major surface to an opening on said outer major surface;

a piezoelectric plate, mounted inside said chamber, with a fixed end fastened on said casing and a free end performing a bending movement; and a signal connector on one side of said fixed end of said piezoelectric plate, issuing signals that cause said bending movement of said piezoelectric plate;

wherein said plurality of spraying holes comprise a plurality of gradually widening holes which allow external air to enter said chamber, thereby regulating said negative pressure in said chamber.

2. The micro-droplet generator according to claims 1, wherein said piezoelectric plate is made of a plurality of layers of different piezoelectric materials.

3. The micro-droplet generator according to claims 1, wherein said spraying holes are placed on a lower side of said casing.

4. The micro-droplet generator according to claims 1, wherein an exchange of liquid and air through said spraying holes takes place, automatically regulating negative pressure in said chamber.

5. The micro-droplet generator according to claims 1, wherein said spraying holes further comprise a plurality of gradually narrowing holes thereby increasing spraying force.

6. The micro-droplet generator according to claims 1, wherein said spraying holes are made of microstructures.

7. The micro-droplet generator according to claims 1, wherein said piezoelectric plate and said spraying plate are placed at a mutual distance, allowing said piezoelectric plate freely to perform said bending movement.

8. The micro-droplet generator according to claims 1, wherein, when said free end of said piezoelectric plate bends towards said spraying plate, liquid undergoes pressure and squeezed out through said spraying holes.

9. The micro-droplet generator according to claims 1, wherein, when said free end of said piezoelectric plate bends away from said spraying plate, air is sucked into said chamber through said spraying holes, balancing negative pressure in said chamber.

* * * * *